US007798494B1

(12) United States Patent
Benjamin

(10) Patent No.: US 7,798,494 B1
(45) Date of Patent: Sep. 21, 2010

(54) AMUSEMENT GAME

(76) Inventor: Gregory Benjamin, 333 McKenzie Dr., Stockbridge, GA (US) 30281

( * ) Notice: Subject to any disclaimer, the term of this patent is extended or adjusted under 35 U.S.C. 154(b) by 572 days.

(21) Appl. No.: 11/788,021

(22) Filed: Apr. 19, 2007

(51) Int. Cl.
*A63D 3/02* (2006.01)

(52) U.S. Cl. ..... 273/119 R; 273/108; 273/108.1; 273/108.5; 273/108.56; 273/108.57; 273/118 R; 273/118 A; 273/119 A; 273/121 R; 273/121 A; 273/122 R; 273/122 A; 273/129 R; 273/129 S; 273/129 T

(58) Field of Classification Search ..... 273/108, 273/108.1, 108.5, 108.56, 108.57, 119 R, 273/129 T, 122 R, 122 A, 129 S, 129 R, 121 R, 273/121 A, 119 A, 118 A, 118 R
See application file for complete search history.

(56) References Cited

U.S. PATENT DOCUMENTS 931,470 A * 8/1909 Patton ..... 273/123 R
1,167,655 A * 1/1916 Passig ..... 273/120 R
1,181,027 A * 4/1916 Mannhardt ..... 273/123 R
1,374,844 A * 4/1921 Flatow ..... 463/69
1,600,624 A * 9/1926 De Boer ..... 273/119 R
1,885,036 A * 10/1932 Gravatt ..... 273/119 R
1,896,915 A * 2/1933 Peo ..... 273/112
1,947,772 A * 2/1934 Harris ..... 273/138.3
2,068,200 A * 1/1937 Shetler ..... 273/337
2,074,512 A * 3/1937 Mills ..... 273/121 E
2,083,540 A * 6/1937 Armstrong ..... 273/119 R
2,752,725 A * 7/1956 Unsworth ..... 446/166
2,866,275 A * 12/1958 Reynolds ..... 434/327
3,050,308 A * 8/1962 Rideout ..... 273/122 R
3,433,484 A * 3/1969 Wallenmeyer ..... 273/120 R
3,471,147 A * 10/1969 Disko et al. ..... 273/449
3,550,942 A * 12/1970 Hawthorne ..... 273/119 R
3,582,074 A * 6/1971 Menotti ..... 273/121 A
3,592,471 A * 7/1971 Swimmer et al. ..... 273/120 R
3,596,911 A * 8/1971 Kessler ..... 273/123 R
3,643,954 A * 2/1972 Meyer et al. ..... 273/119 A
3,655,191 A * 4/1972 Grant ..... 273/343
3,770,276 A * 11/1973 Breslow ..... 273/119 R
3,807,736 A * 4/1974 Goldfarb et al. ..... 273/122 R
3,853,318 A * 12/1974 Cagan ..... 273/379
3,901,508 A * 8/1975 Spangler ..... 273/317.3
3,934,881 A * 1/1976 Goldfarb et al. ..... 273/110
3,941,381 A * 3/1976 Trbovich ..... 273/317.1
4,055,344 A * 10/1977 Soucie ..... 273/110
4,166,620 A * 9/1979 Sheppard ..... 273/108.5
4,244,575 A * 1/1981 Hori ..... 273/127 D
4,269,413 A * 5/1981 Langieri ..... 273/121 R
4,335,878 A * 6/1982 Nishimiya ..... 273/119 R
4,474,558 A * 10/1984 Quercetti ..... 434/189
4,508,336 A * 4/1985 Yokoi ..... 273/457
4,508,343 A * 4/1985 Peters et al. ..... 273/119 A
4,606,545 A * 8/1986 Ritchie ..... 273/121 A
4,805,906 A * 2/1989 Wiczer et al. ..... 273/119 A
4,822,047 A * 4/1989 Treer ..... 273/113
4,840,375 A * 6/1989 Lawlor et al. ..... 273/121 A (Continued)

*Primary Examiner*—Gene Kim
*Assistant Examiner*—Alexander R Niconovich
(74) *Attorney, Agent, or Firm*—Joseph H. McGlynn

(57) ABSTRACT

An amusement device which uses a case containing balls that are shot from one side of the case to the other, and pegs are positioned at the bottom of the case to facilitate scoring. A second container is positioned at the top of the case so the game can be turned upside down in order to continue the game or to start a new game.

3 Claims, 3 Drawing Sheets

U.S. PATENT DOCUMENTS 4,900,026 A * 2/1990 Kulesza et al. ..... 273/119 A
5,016,879 A * 5/1991 Parker et al. ..... 273/126 A
5,064,196 A * 11/1991 Gottlieb ..... 273/121 A
5,295,693 A * 3/1994 Dobson ..... 273/441
5,316,307 A * 5/1994 Kersh ..... 273/241
5,332,216 A * 7/1994 Whipple ..... 273/120 R
5,368,300 A * 11/1994 Becker ..... 273/121 R
5,494,292 A * 2/1996 Mileti ..... 273/241
5,632,482 A * 5/1997 Anghelo ..... 273/121 R
5,634,639 A * 6/1997 Tokito et al. ..... 273/123 R
5,667,217 A * 9/1997 Kelly et al. ..... 273/126 R
5,697,611 A * 12/1997 Kelly et al. ..... 273/126 A
5,697,612 A * 12/1997 Piotrowski et al. ..... 273/127 R
5,971,269 A * 10/1999 Baguley ..... 235/68
5,971,830 A * 10/1999 Tobin ..... 446/256
5,988,637 A * 11/1999 Dickerson ..... 273/118 R
6,010,130 A * 1/2000 Schreiber ..... 273/121 B
6,056,620 A * 5/2000 Tobin ..... 446/168
6,066,105 A * 5/2000 Guillen ..... 600/595
6,082,734 A * 7/2000 Uehara et al. ..... 273/142 E
6,179,295 B1 * 1/2001 Lanza ..... 273/402
6,209,868 B1 * 4/2001 Norton ..... 273/118 R
6,220,593 B1 * 4/2001 Pierce et al. ..... 273/138.1
6,257,573 B1 * 7/2001 Munoz et al. ..... 273/121 B
6,279,904 B1 * 8/2001 Huang ..... 273/121 R
6,296,568 B1 * 10/2001 Tracy ..... 463/17
6,398,216 B1 * 6/2002 Humphrey ..... 273/118 R
6,497,407 B2 * 12/2002 Humphrey ..... 273/118 R
6,513,807 B1 * 2/2003 Lynch ..... 273/119 R
6,554,278 B1 * 4/2003 Haddox ..... 273/119 R
6,688,596 B2 * 2/2004 Nielsen ..... 273/120 R
6,695,698 B1 * 2/2004 Anghelo et al. ..... 463/25
6,712,710 B2 * 3/2004 Pearson ..... 473/10
7,052,011 B2 * 5/2006 Pierce et al. ..... 273/139
7,284,756 B2 * 10/2007 Pierce et al. ..... 273/121 B
7,326,059 B2 * 2/2008 Habing et al. ..... 434/236
7,389,987 B1 * 6/2008 Paukert ..... 273/108.1
2002/0098896 A1 * 7/2002 Rieber et al. ..... 473/10
2003/0155707 A1 * 8/2003 Nielsen ..... 273/118 R
2003/0197326 A1 * 10/2003 Makhoul ..... 273/108.54
2005/0049056 A1 * 3/2005 Padilla ..... 473/10
2006/0019735 A1 * 1/2006 Toyoda ..... 463/17
2006/0119030 A1 * 6/2006 Simon ..... 273/108.52
2008/0001354 A1 * 1/2008 Ting ..... 273/119 R
2008/0143047 A1 * 6/2008 Lokos ..... 273/121 R

* cited by examiner

AMUSEMENT GAME

BACKGROUND OF THE INVENTION

This invention relates, in general, to amusement devices, and, in particular, to amusement devices with diverters that can be operated to change the direction of an opponent's ball.

DESCRIPTION OF THE PRIOR ART

In the prior art various types of amusement devices have been proposed. For example, U.S. Pat. No. 6,010,130 to Schreiber discloses a vertical marble game with an upright marble track with slots and dividers and wherein the diverters are shiftable about an axis.

U.S. Pat. No. 5,332,216 to Whipple discloses a marble game having a plurality of directional elements which are attached to a vertical face to define paths along which a marble can travel.

U.S. Pat. No. 3,901,508 to Spangler discloses a table top game which simulates the game of basketball.

U.S. Pat. No. 3,807,736 to Goldfarb et al discloses a marble game board in which paths for the marbles are formed by depressions.

SUMMARY OF THE INVENTION

The present invention is directed to an amusement device which uses a case containing balls that are shot from one side of the case to the other, and pegs are positioned at the bottom of the case to facilitate scoring. A second container is positioned at the top of the case so the game can be turned upside down in order to continue the game or to start a new game.

It is an object of the present invention to provide a new and improved amusement device to provide another outlet for people to relax while having fun with family and friends.

It is an object of the present invention to provide a new and improved amusement device which can be played by players of a wide variety of ages.

It is an object of the present invention to provide a new and improved amusement device which is easy to learn and can be played in a variety of locations.

These and other objects and advantages of the present invention will be fully apparent from the following description, when taken in connection with the annexed drawings.

DESCRIPTION OF THE PREFERRED EMBODIMENT

Figure 1:
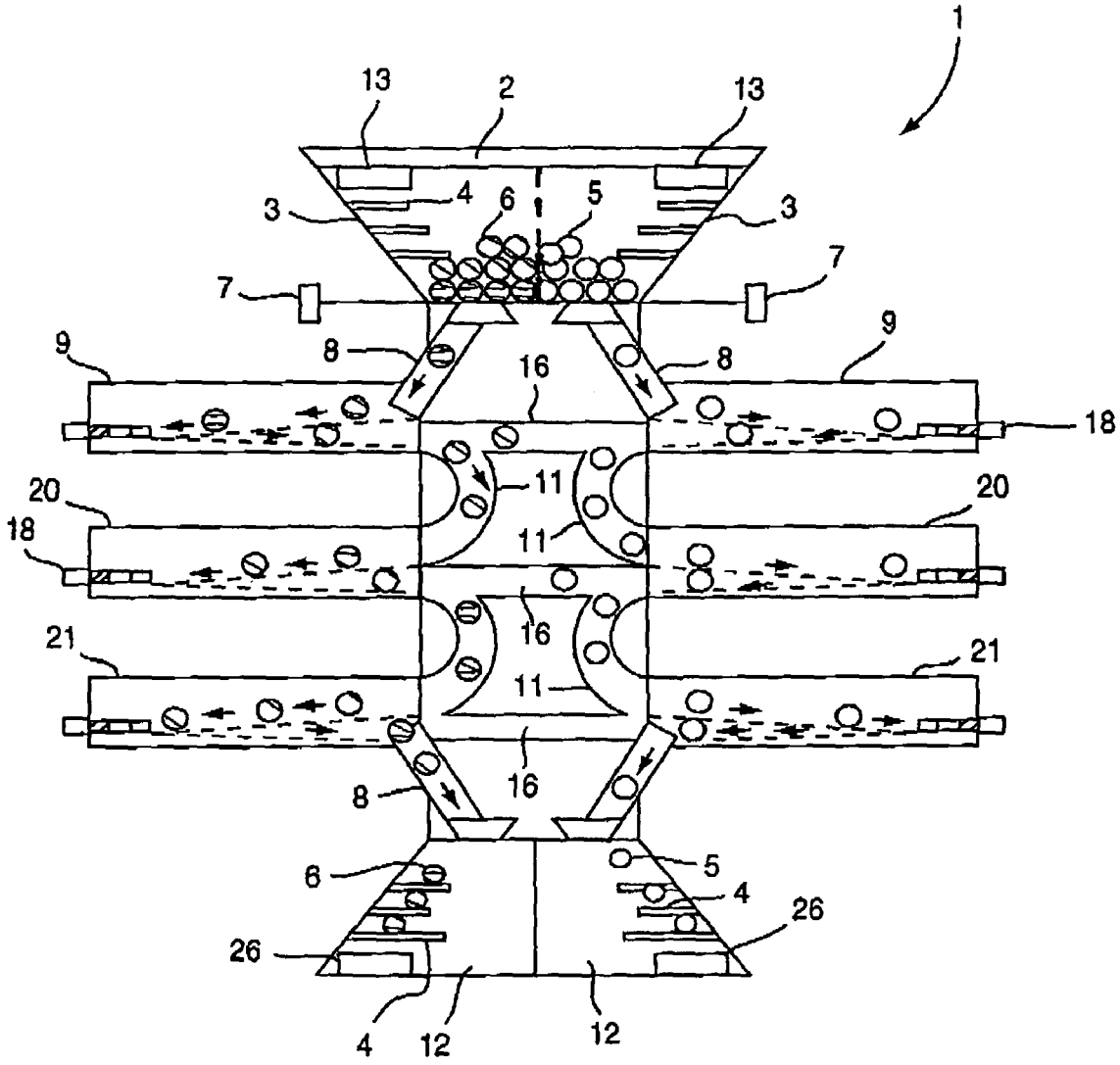
FIG. 1 is a front view of the present invention.

Referring now to the drawings in greater detail, FIG. 1 shows a front view of the amusement device 1 of the present invention. It should be noted that the device may have a transparent case which is not shown in FIG. 1 for clarity. The device has a top portion 2 which is divided into two ball hoppers 3, one for each of the players. Playing pieces such as balls or marbles 5 for one player occupy one hopper 12 and playing pieces 6 for another player occupy another hopper 3. The hoppers have a partition so the respective balls are separated from each other. The device is designed so that once the balls are placed in the device they can not be removed. This is for safety reasons to protect small children from accidentally swallowing the balls. Any conventional means can be used to seal the balls inside the device. Apertures can be provided at any convenient location for supplying the balls into the device, and the apertures can then be sealed by a closure which can not be removed. Another method is to provide an aperture that allows the balls to be inserted but will not allow the balls to be removed through the aperture.

Figure 4:
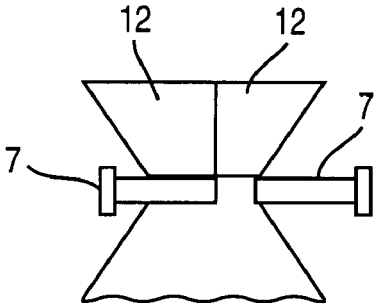
FIG. 4 is a partial front view of the release mechanisms for the ball hoppers of the present invention.

A passage is provided in the floor of each hopper 3 and is closed by a ball releaser 7. The ball releaser is also shown in FIG. 4. Each hopper has a ball releaser that, as shown on the right of FIG. 7 will prevent the balls in the hopper from moving out of the hopper. When the ball releaser 7 is mover from the position shown on the right of FIG. 7 to the position shown by the ball releaser on the left of FIG. 7, the balls (not shown in FIG. 4 for clarity, but shown in FIG. 1) will drop into the first playing level. Since each side of the device is identical, only one side of the amusement device will be described.

Figure 5:
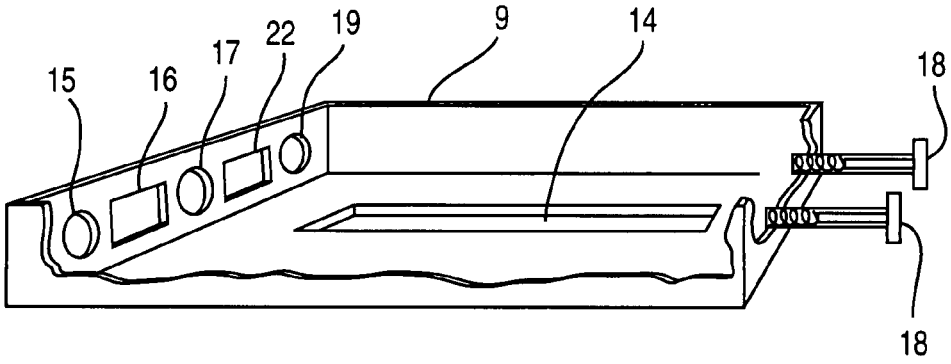
FIG. 5 is a partial view of one of the playing levels of the present invention.

Once the balls are released by the ball releaser 7, they will pass through passageway 8 to the first playing level 9. Playing level 9 is shown in more detail in FIG. 5. The level is constructed on a 5° slope so the balls will tend to roll from the position where they enter the level toward the plunger 18 as shown by the dotted lines in FIG. 1. As shown in FIG. 5, there are two plungers 18 on each level and they are similar to and operate in the same manner as pinball plungers. Therefore, no further description is necessary or will be given. There is an entrance aperture 15 and two exit apertures 17, 19 which lead to the next level 20. There are also two exits 16 and 22 which lead to tunnels that extend from level one on one player's side of the device to level one on the other player's side of the device. Each level 9, 20 and 21 are the same and have the same entrance and exit apertures. The entrance apertures on level two (20) lead from level one to level two, and some of the exit apertures on level two (20) lead from level two on one player's side of the device to level two on the other player's side of the device, similar to level one. Some of the apertures on level two (20) lead from level two to level three (21) similar to level one.

Each player can use the plungers 18 to force his balls through the exits 16, 22 to his opponent's side of the device, which will score him points, or he can send the balls through apertures 17, 19 where they will descend to the next level. If a ball is accidentally shot into the entrance aperture 15, the 5° slope will tend to return it toward the plungers 18 where the player will have another shot at it with the plungers.

Figure 6:
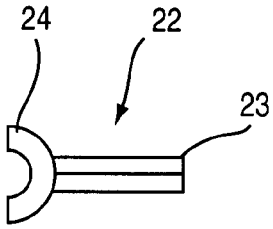
FIG. 6 is a top view of one of the ball assists of the present invention.

Each level also has a slot 14 in the floor. The slot is dimensioned so it will be too small for the balls 5, 6 to fall through. However, it will be large enough for the ball assist 22 (as seen in FIG. 6) to pass through. The ball assist 22 has a handle 23 and a substantially U-shaped head 24. The head 24 will be inserted through the slot 14 and manipulated by the handle to retrieve any ball that has become stuck on a level.

Figure 7:
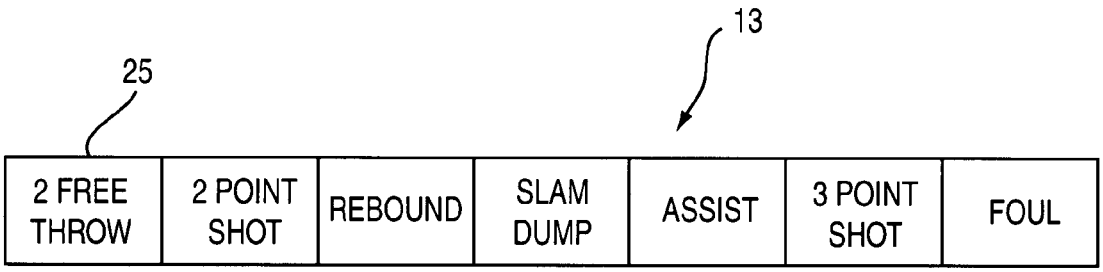
FIG. 7 is a view of one of the scoring compartments of the present invention.

The players manipulate the balls so they fall through the levels 9, 20, 21 by means of passageways 8, 11 until they come to the scoring level 26 at a bottom portion of the device. The scoring level is a ball hopper which is identical to the ball hopper at the top of the device. The scoring level has a scoring tray 13 with a plurality of scoring compartments 25 as shown in FIG. 7. Each of the compartments are labeled such as, 2 Free Throw, 2 Point Shot, Rebound, Slam Dump, Assist, 3 Point Shot, and Foul. These designations are merely for illustration purposes and other designations can be used without departing from the scope of the invention. As the balls fall into the scoring tray they will drop into one of the compartments which will score points for the player. The scoring can be computed as follows:

| Points | Activity |
|---|---|
| 1 point | For each ball in the tray |
| 2 points | For each ball in the 2 Point Shot slot |
| 2 points | For each ball in the 2 Free Throw slot |
| 3 points | For each ball in the 3 Point shot slot |
| 5 points | For each ball in the Slam Dump slot |
| −4 points | For each ball in the Foul slot |

Also, each player will lose points if his opponent's ball falls into the player's scoring tray. For example, if player one's ball falls into player two's Slam Dump slot player two will lose 5 points. Once all of the balls are in the scoring tray, the game device can be turned upside down to start the game over or to continue on with the present game. Since the hoppers 3 and 26 are the same, merely upending the device will place the it in position to start again.

Figure 2:
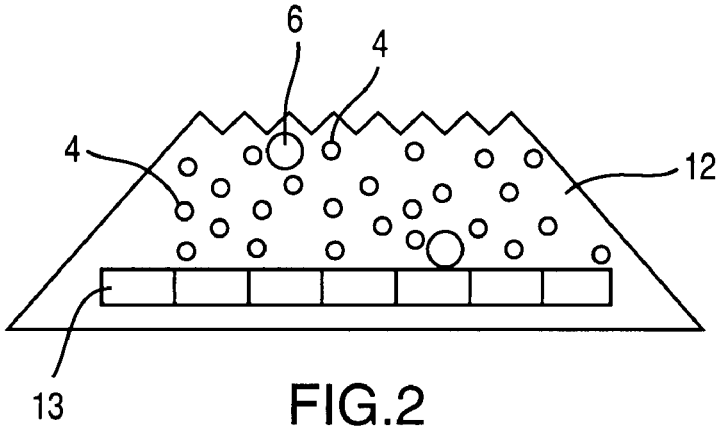
FIG. 2 is a partial front view of one of the ball hoppers of the present invention.
Figure 3:
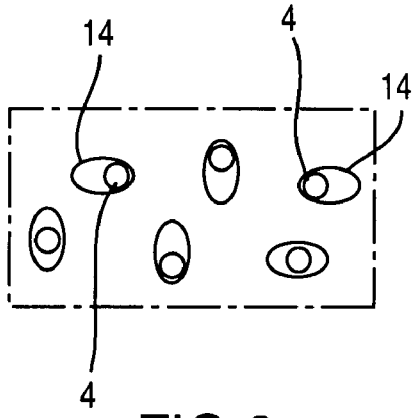
FIG. 3 is a partial side view of one of the ball hoppers of the present invention.

In order to add a degree of difficulty to the game pegs 4 are positioned in the hoppers 3, 26. The pegs are shown in more detail in FIGS. 2 and 3. The pegs are placed in rows and columns so the downward flow direction of the balls can be changed. The space between two adjacent pegs do not exceed the width of two game balls. A portion of each peg is outside the confines of the device so the players can move them. Each peg will have the ability of moving in different directions. FIG. 3 shows the pegs placed in different positions. Each peg 4 is placed in an oval slot 14. The pegs can be held in the slots by any conventional manner. Each peg is placed in the center of the oval slot 14, at the left, right, top or bottom of the slot, depending on how the slot is oriented and the desire of the players. Players can elect to place their own peg or they can elect to place their opponents pegs. Due to the position of the pegs, luck will play a large role in the scoring. Also, since there is an almost infinite number of peg placements, each game will be different.

Although the game and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An amusement device comprising:

a top portion and a bottom portion, said top portion being divided into a plurality of hoppers, each of said hoppers having a plurality of playing pieces, means for holding said playing pieces in said hoppers, and means for releasing said playing pieces from said hoppers, a plurality of playing levels positioned below said top portion, and means connecting said plurality of hoppers with a first of said plurality of playing levels for allowing playing pieces to move from said plurality of hoppers to said first of said plurality of playing levels, and means connecting said first of said plurality of playing levels with at least a second of said plurality of playing levels for allowing playing pieces to move from said first of said plurality of playing levels to said second of said plurality of playing levels, and means for moving said playing pieces from said first of said plurality of playing levels to said second of said plurality of playing levels, and means for scoring points as said playing pieces move from said top portion to said bottom portion, and wherein said means for scoring points comprises a plurality of compartments in said bottom portion, and wherein said means for scoring points also comprises a plurality of pegs positioned above said plurality of compartments, and wherein said plurality of pegs are adjustably positioned above said plurality of compartments, and wherein each of said plurality of pegs is mounted in an oval shaped aperture, and each of said plurality of pegs can be mounted at the center or the left or right of said oval shaped aperture.

2. An amusement device comprising:

a top portion and a bottom portion, said top portion being divided into a plurality of hoppers, each of said hoppers having a plurality of playing pieces, means for holding said playing pieces in said hoppers, and means for releasing said playing pieces from said hoppers, a plurality of playing levels positioned below said top portion, and means connecting said plurality of hoppers with a first of said plurality of playing levels for allowing playing pieces to move from said plurality of hoppers to said first of said plurality of playing levels, and means connecting said first of said plurality of playing levels with at least a second of said plurality of playing levels for allowing playing pieces to move from said first of said plurality of playing levels to said second of said plurality of playing levels, and means for moving said playing pieces from said first of said plurality of playing levels to said second of said plurality of playing levels, and means for scoring points as said playing pieces move from said top portion to said bottom portion, and wherein said means for scoring points comprises a plurality of compartments in said bottom portion, and wherein said means for scoring points also comprises a plurality of pegs positioned above said plurality of compartments, and wherein said plurality of pegs are adjustably positioned above said plurality of compartments, wherein each of said plurality of pegs is mounted in an oval shaped aperture, and each of said plurality of pegs can be mounted at the top or bottom of said oval shaped aperture.

3. An amusement device comprising:

a top portion and a bottom portion, said top portion being divided into a plurality of hoppers, each of said hoppers having a plurality of playing pieces, means for holding said playing pieces in said hoppers, and means for releasing said playing pieces from said hoppers, a plurality of playing levels positioned below said top portion, and means connecting said plurality of hoppers with a first of said plurality of playing levels for allowing playing pieces to move from said plurality of hoppers to said first of said plurality of playing levels, and means connecting said first of said plurality of playing levels with at least a second of said plurality of playing levels for allowing playing pieces to move from said first of said plurality of playing levels to said second of said plurality of playing levels, and means for moving said playing pieces from said first of said plurality of playing levels to said second of said plurality of playing levels, and means for scoring points as said playing pieces move from said top portion to said bottom portion, and wherein said top portion has means for scoring points positioned therein, whereby when said playing pieces reach said bottom portion said amusement device can be turned upside down to start again.

* * * * *